US007009126B2

(12) United States Patent
Etscheidt et al.

(10) Patent No.: US 7,009,126 B2
(45) Date of Patent: Mar. 7, 2006

(54) LOAD TERMINAL COVER

(75) Inventors: Ronald J. Etscheidt, Anamosa, IA (US); Douglas P. VanWaart, Anamosa, IA (US)

(73) Assignee: Square D Company, Palatine, IL (US)

( * ) Notice: Subject to any disclaimer, the term of this patent is extended or adjusted under 35 U.S.C. 154(b) by 76 days.

(21) Appl. No.: 10/721,050

(22) Filed: Nov. 24, 2003

(65) Prior Publication Data

US 2005/0109597 A1 May 26, 2005

(51) Int. Cl.
*H01H 1/64* (2006.01)

(52) U.S. Cl. ..... 200/293; 200/303

(58) Field of Classification Search ..... 200/293, 200/303, 306, 307, 400, 244; 335/8–10, 335/132, 202; 361/600; 439/810–814
See application file for complete search history.

(56) References Cited

U.S. PATENT DOCUMENTS 3,596,032 A * 7/1971 Roossinck ..... 200/293
4,754,247 A * 6/1988 Raymont et al. ..... 335/202
5,084,689 A * 1/1992 Morgan et al. ..... 335/202
5,304,761 A * 4/1994 Rosen et al. ..... 218/157
5,408,044 A * 4/1995 Spiegel ..... 174/52.1
5,652,420 A * 7/1997 Innes et al. ..... 200/50.32
5,811,749 A * 9/1998 Bausch et al. ..... 218/157
6,144,001 A * 11/2000 Green et al. ..... 200/304
6,147,419 A * 11/2000 Girard ..... 307/116
6,198,063 B1 * 3/2001 Kramer ..... 218/157
6,201,460 B1 * 3/2001 Winslett et al. ..... 335/172
6,252,480 B1 * 6/2001 Kramer ..... 335/172
6,255,925 B1 * 7/2001 DiMarco et al. ..... 335/176
6,275,126 B1 * 8/2001 Martelli et al. ..... 335/202
6,307,456 B1 * 10/2001 Caggiano et al. ..... 335/202
6,356,175 B1 * 3/2002 DeGrazia et al. ..... 335/202
6,512,433 B1 * 1/2003 Bouchard et al. ..... 335/6
6,515,850 B1 * 2/2003 Fournier et al. ..... 361/627
6,534,735 B1 * 3/2003 Czarnecki ..... 200/333
6,700,082 B1 * 3/2004 Gibson et al. ..... 200/50.1

* cited by examiner

*Primary Examiner*—Lisa Nhung Klaus

(57) ABSTRACT

A terminal cover for use on molded case circuit breakers. The terminal cover limits access to circuit breaker electrical terminals and uninsulated portions of electrical conductors entering the terminals. The terminal cover also provides selective access to the terminal binding screws.

19 Claims, 4 Drawing Sheets

LOAD TERMINAL COVER

CROSS-REFERENCE TO RELATED PATENTS

Not applicable

STATEMENT REGARDING FEDERALLY SPONSORED RESEARCH OR DEVELOPMENT

Not applicable

FIELD OF THE INVENTION

The present invention relates to molded case circuit breakers, and particularly to a load terminal cover for molded case circuit breakers.

BRIEF DESCRIPTION OF THE DRAWINGS

The features of the invention will become more clearly understood from the following detailed description of the invention read together with the drawings in which.

Figure 1:
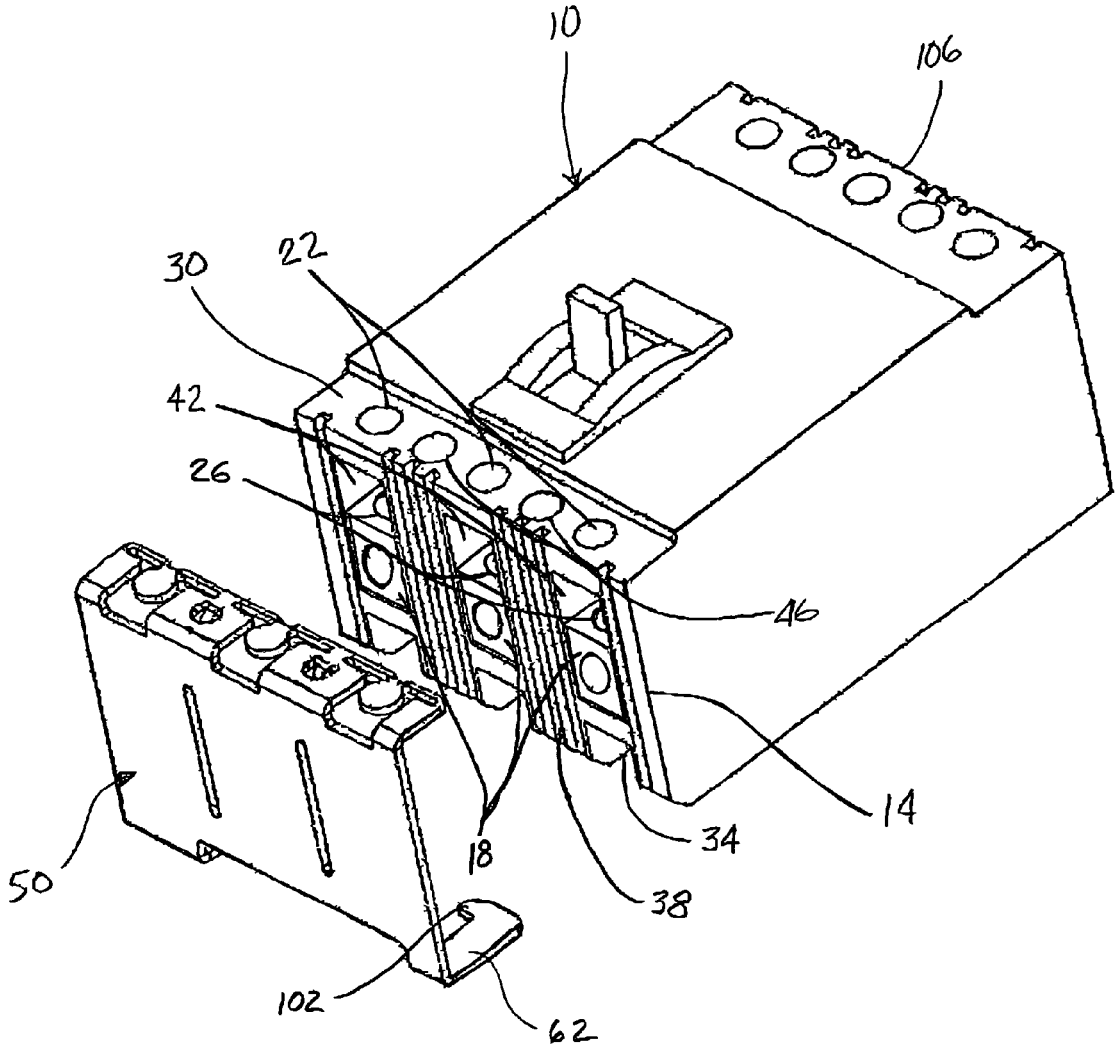
FIG. 1 illustrates a typical multi-phase molded case circuit breaker and a load terminal cover assembly constructed in accordance with the present invention.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates a typical multi-phase molded case circuit breaker, generally indicated by reference numeral 10. The circuit breaker 10 includes a load end 14 in which the circuit breaker's load terminals 18 are located. Binding screw access apertures 22, which provide access to the load terminal binding screws 26, are defined in a top surface 30 of the circuit breaker 10 at the load end 14. The circuit breaker 10 also has a bottom surface 34, which is generally parallel to the top surface 30, and a load end wall 38 that extends between the top and bottom surfaces, 30 and 34, respectively. The load end wall 38 defines load terminal apertures 42 for receiving the load terminals 18. The load end 14 of the molded case circuit breaker 10 also includes apertures 46 for mounting hardware, such as screws (not shown), which secures the circuit breaker 10 in a panelboard, switchboard, load center or other electrical enclosure (not shown). A load terminal cover constructed in accordance with the present invention is illustrated generally by reference numeral 50.

Figure 2:
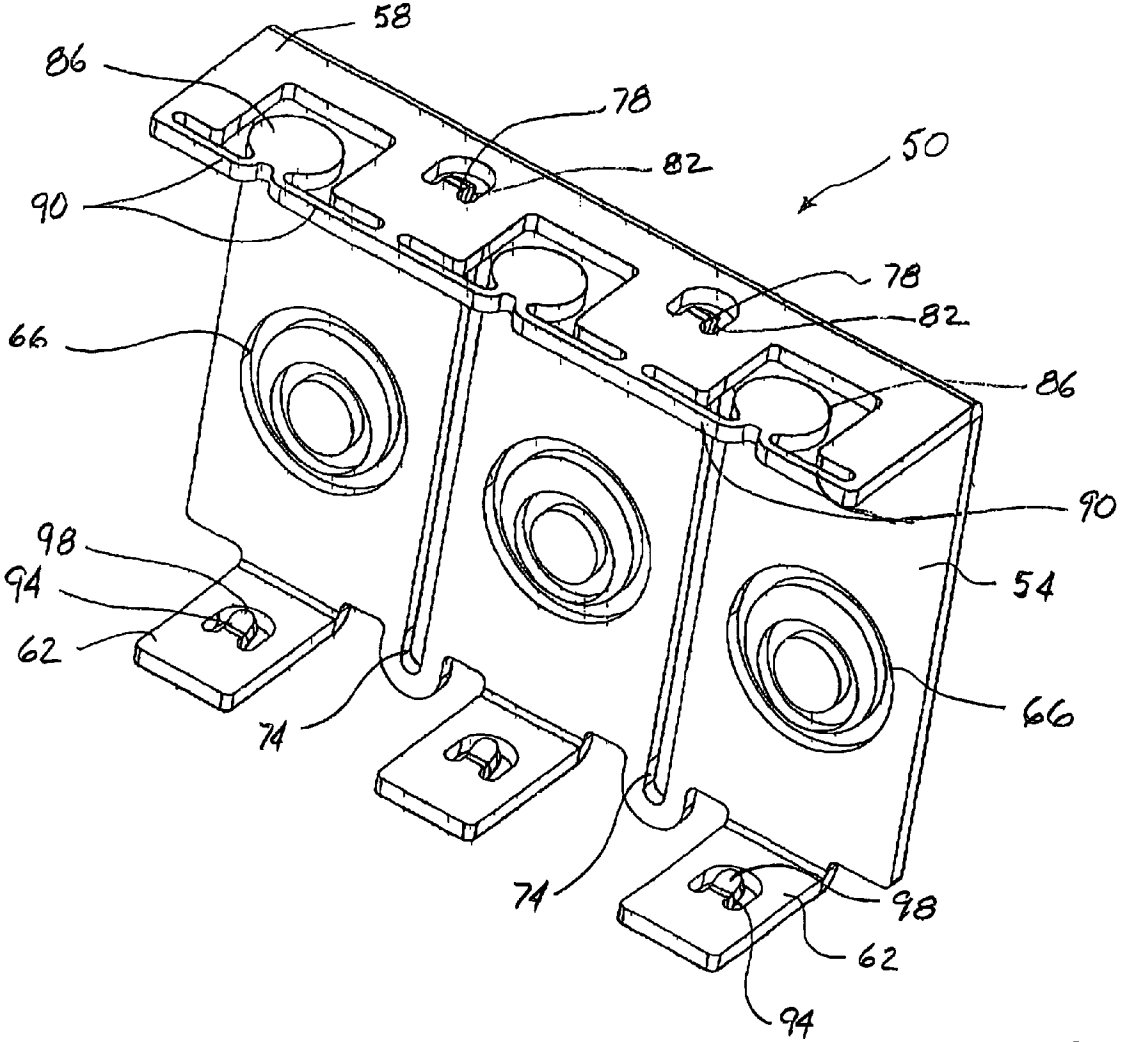
FIG. 2 is an isometric view of load terminal cover constructed in accordance with the present invention.
Figure 3:
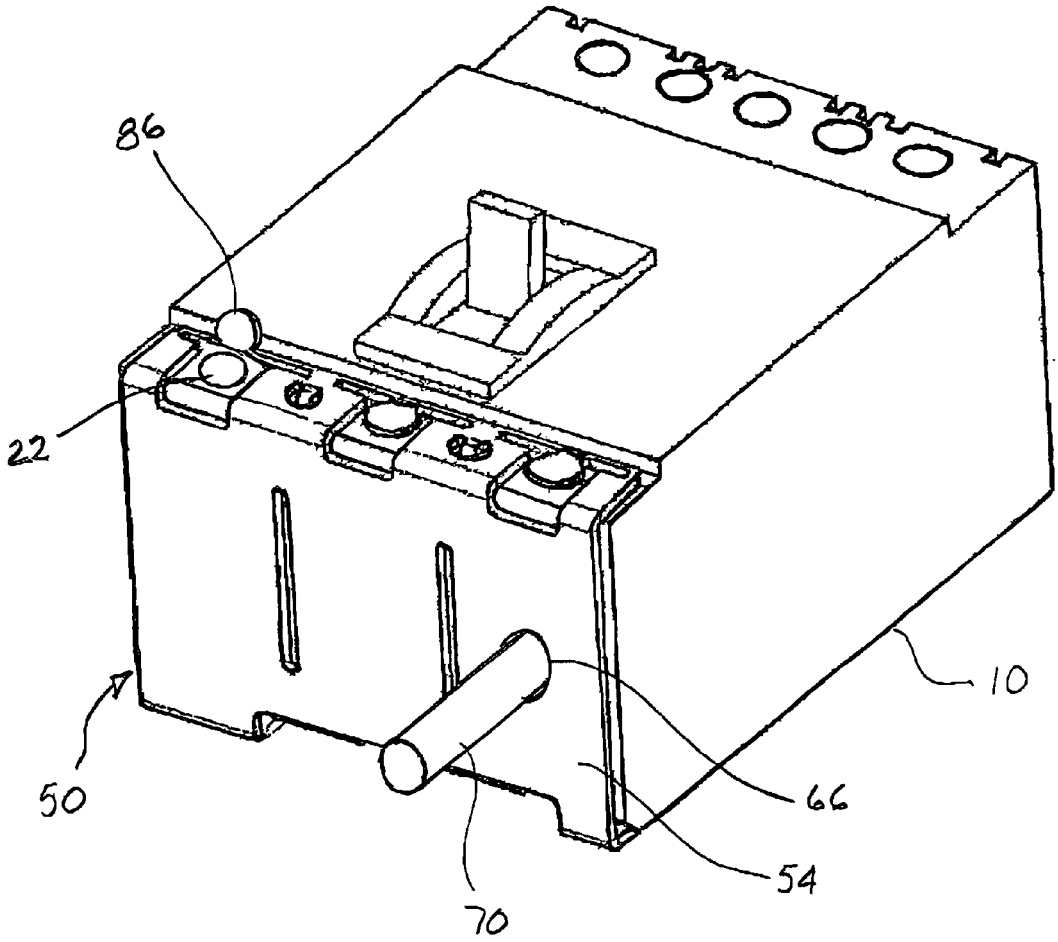
FIG. 3 is an isometric view illustrating the load terminal cover of FIG. 2 installed on the circuit breaker of FIG. 1.
Figure 4:
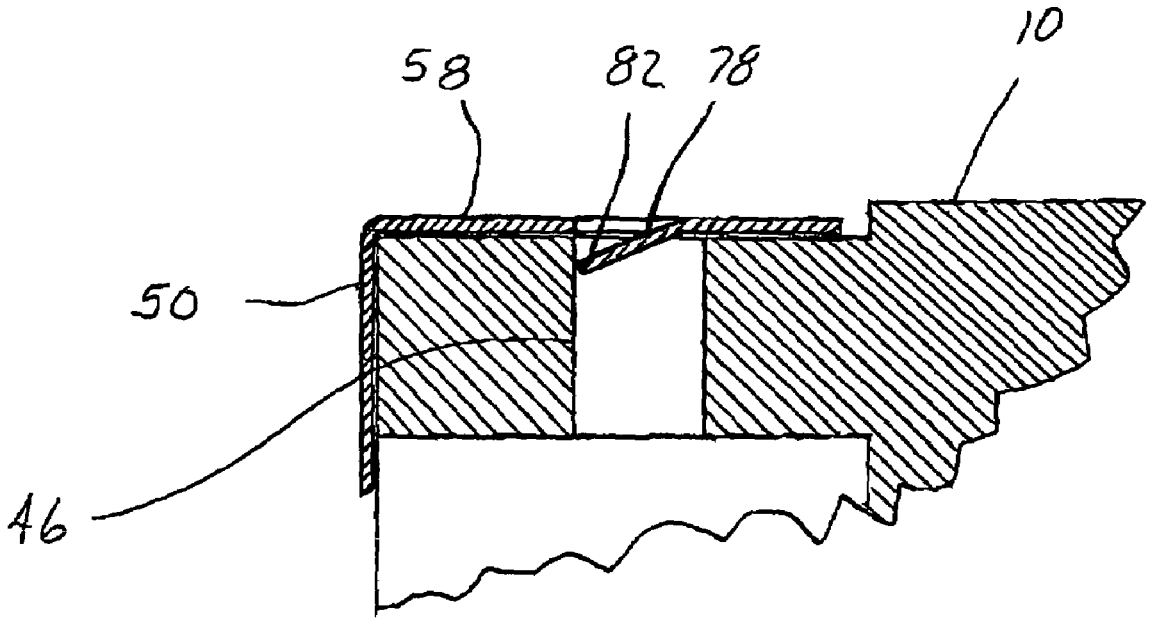
FIG. 4 is a cross-sectional view of one embodiment of the load terminal cover attachment feature.

FIG. 2 illustrates, in greater detail, the circuit breaker load terminal cover 50, constructed in accordance with the present invention. Each load terminal cover 50 includes an end wall 54, a top flange 58 and at least one bottom flange 62. The end wall 54 is dimensioned to cover the load end wall 38 of circuit breaker 10 and is intermediate the top and bottom flanges, 58 and 62, respectively. The end wall 54 defines at least one knockout 66 for each load terminal 18. The knockouts 66 can be of one predetermined diameter for a single load conductor 70 (FIG. 3) or a have number of tangential or concentric diameters, each of increasing diameter for a larger size load conductor 70 or multiple load conductors 70. The knockouts 66 are removed when the circuit breaker 10 is activated. The end wall 54 can also define electrical clearance features 74 such as a slot, groove, or rib, which provides the required over surface electrical clearance between adjacent electrical phases of different polarity. The top flange 58 is dimensioned to cover that part of the circuit breaker top surface 30 defining the binding screw access apertures 22. The top flange 58 defines at least one integrally formed attaching member 78, which terminates at a distal end 82, and one non-removable load terminal binding screw access cover 86 for each binding screw access aperture 22 of the circuit breaker 10. The load terminal binding screw access cover 86 is integrally attached to the top flange 58 by two pivot arms 90. In its normal position, each load terminal binding screw access cover 86 covers one binding screw access aperture 22 in the top surface 30 of circuit breaker 10. The load terminal binding screw access cover 86 is rotated upward or downward (see FIG. 3) to permit access to the load terminal binding screw 26. The load terminal binding screw access cover 86 is dimensioned to be slightly smaller than the binding screw access aperture 22, and is shaped to generally conform with the shape of the binding screw access aperture 22. The bottom flange 62 also defines at least one integrally formed attaching member 94, which terminates at a distal end 98. The top and bottom flanges, 58 and 62 respectively, are approximately parallel to one another and configured to snugly slide over the top and bottom surfaces, 30 and 34, respectively, of the circuit breaker 10. In one embodiment, the attaching members 78 and 94 can be configured in the same manner such that the distal ends 82 and 98 are angled inwardly toward each other. In this configuration, the distance between the two distal ends 82 and 98 is less than the distance between the top and bottom flanges, 58 and 62, respectively. In another embodiment, one of the attaching members 78 or 94 can be configured as a hook 102 (FIG. 1). The attaching members 78 and 94 are positioned on the top and bottom flanges, 58 and 62, respectively, for engaging features defined in the top and bottom surfaces, 30 and 34, respectively, of the circuit breaker 10. It is to be understood that the features to be engaged can be existing features that originally were provided for other functions, thus permitting the installation of terminal covers 50 on older circuit breakers 10. For instance, in the first embodiment, the distal end 82 of attaching member 78 can engage the aperture 46 of the circuit breaker top surface 30 while the distal end 98 of attaching member 94 can engage an aperture, groove or similar recess defined in the bottom surface 34 of circuit breaker 10. As shown in the cross-sectional view of FIG. 4, the angle of the attaching member 78 is such that an attempt to slidably remove the load terminal cover 50 from the circuit breaker 10 causes the distal end 82 to further penetrate the aperture 46, thereby increasing the resistance to removal. The hook-like feature 102 of the second embodiment can engage a protruding feature (not shown) on the bottom surface 34 of the circuit breaker 10.

It is to be understood that, although the description has been written in terms of a load terminal cover 50, in many molded case circuit breakers 10, the line end 106 (FIG. 1) is configured in the same manner as the load end 14. Therefore, the load terminal cover 50, as described herein, can be also be used on the line end 106.

FIG. 2 illustrates, in greater detail, the circuit breaker load terminal cover 50, constructed in accordance with the present invention. Each load terminal cover 50 includes an end wall 54, a top flange 58 and at least one bottom flange 62. The end wall 54 is dimensioned to cover the load end wall 38 of circuit breaker 10 and is intermediate the top and bottom flanges, 58 and 62, respectively. The end wall 54 defines at least one knockout 66 for each load terminal 18. The knockouts 66 can be of one predetermined diameter for a single load conductor 70 (FIG. 3) or a have number of tangential or concentric diameters, each of increasing diameter for a larger size load conductor 70 or multiple load conductors 70. The knockouts 66 are removed when the circuit breaker 10 is activated. The end wall 54 can also define electrical clearance features 74 such as a slot, groove, or rib, which provides the required over surface electrical clearance between adjacent electrical phases of different polarity. The top flange 58 is dimensioned to cover that part of the circuit breaker top surface 30 defining the binding screw access apertures 22. The top flange 58 defines at least one integrally formed attaching member 78, which terminates at a distal end 82, and one non-removable load terminal binding screw access cover 86 for each binding screw access aperture 22 of the circuit breaker 10. The load terminal binding screw access cover 86 is integrally attached to the top flange 58 by two pivot arms 90. In its normal position, each load terminal binding screw access cover 86 covers one binding screw access aperture 22 in the top surface 30 of circuit breaker 10. The load terminal binding screw access cover 86 is rotated upward or downward (see FIG. 3) to permit access to the load terminal binding screw 26. The load terminal binding screw access cover 86 is dimensioned to be slightly smaller than the binding screw access aperture 22, and is shaped to generally conform with the shape of the binding screw access aperture 22. The bottom flange 62 also defines at least one integrally formed attaching member 94, which terminates at a distal end 98. The top and bottom flanges, 58 and 62 respectively, are approximately parallel to one another and configured to snugly slide over the top and bottom surfaces, 30 and 34, respectively, of the circuit breaker 10. In one embodiment, the attaching members 78 and 94 can be configured in the same manner such that the distal ends 82 and 98 are angled inwardly toward each other. In this configuration, the distance between the two distal ends 82 and 98 is less than the distance between the top and bottom flanges, 58 and 62, respectively. In another embodiment, one of the attaching members 78 or 94 can be configured as a hook 102 (FIG. 1). The attaching members 78 and 94 are positioned on the top and bottom flanges, 58 and 62, respectively, for engaging features defined in the top and bottom surfaces, 30 and 34, respectively, of the circuit breaker 10. It is to be understood that the features to be engaged can be existing features that originally were provided for other functions, thus permitting the installation of terminal covers 50 on older circuit breakers 10. For instance, in the first embodiment, the distal end 82 of attaching member 78 can engage the aperture 46 of the circuit breaker top surface 30 while the distal end 98 of attaching member 94 can engage an aperture, groove or similar recess defined in the bottom surface 34 of circuit breaker 10. As shown in the cross-sectional view of FIG. 4, the angle of the attaching member 78 is such that an attempt to slidably remove the load terminal cover 50 from the circuit breaker 10 causes the distal end 82 to further penetrate the aperture 46, thereby increasing the resistance to removal. The hook-like feature 102 of the second embodiment can engage a protruding feature (not shown) on the bottom surface 34 of the circuit breaker 10.

We claim:

1. A terminal cover for a molded case circuit breaker having a load end enclosing at least one electrical terminal and a line end enclosing at least one electrical terminal, each of the circuit breaker's load and line ends having an end wall defining at least one aperture for accessing the respective electrical terminals, and a top surface defining at least one aperture for accessing a terminal binding screw associated with each of the electrical terminals and a bottom surface being generally parallel to the top surface, said terminal cover comprising:

a terminal cover end wall, being generally flat and dimensioned to cover said circuit breaker end wall, a top flange and a bottom flange being generally perpendicular to and spaced apart by said end wall, said top and bottom flanges each defining at least one means for attaching said terminal cover to said molded case circuit breaker.

2. The terminal cover of claim 1, wherein said terminal cover end wall defines at least one conductor knockout, whereby when removed said conductor knockout provides an aperture for receiving at least one electrical conductor to be connected to one of the electrical terminals.

3. The terminal cover of claim 2, wherein said at least one conductor knockout is a series of tangential or concentric knockouts, each increasing in diameter to accommodate one or more electrical conductors of larger diameter.

4. The terminal cover of claim 1, wherein said terminal cover end wall further defines a means for increasing the over surface electrical clearance between adjacent electrical phases of different polarity.

5. The terminal cover of claim 1, wherein said top flange further defines at least one non-removable binding screw access cover for selectively providing access to one terminal binding screw.

6. The terminal cover of claim 5, wherein said at least one non-removable binding screw access cover is integrally attached to said top flange by two pivot arms such that said binding screw access cover is rotated upwardly or downwardly to provide access to the terminal binding screw.

7. The terminal cover of claim 1, wherein said top and bottom flanges slidably and snugly engage the top and bottom surfaces, respectively, of the molded case circuit breaker.

8. The terminal cover of claim 7, wherein said means for attaching said terminal cover to the molded case circuit breaker includes at least one member extending inwardly from each of said top and bottom flanges such that a distal end of opposing said members positively engage recesses defined in the top and bottom surfaces of the molded case circuit breaker.

9. The terminal cover of claim 8, wherein said member defined by one of said top or bottom flanges is hook-like in configuration such that a protrusion defined by one of the top or bottom surfaces of the molded case circuit breaker is positively engaged.

10. A load terminal cover for a molded case circuit breaker having load terminals and apertures for accessing load terminal binding screws, said load terminal cover comprising:

an end wall dimensioned to cover an end wall of said molded case circuit breaker, a top flange and a bottom flange being approximately perpendicular to and spaced apart by said end wall, said top flange and bottom flange each defining at least one attachment means for attaching said load terminal cover to said molded case circuit breaker, said top flange further defining binding screw access covers for selectively permitting or restricting unintentional access to said load terminal binding screws.

11. The load terminal cover of claim 10, wherein said load terminal cover end wall defines at least one conductor knockout, when removed said conductor knockout provides an aperture for receiving at least one load conductor to be connected to one of the load terminals.

12. The load terminal cover of claim 10, wherein said load terminal cover end wall further defines a means for increasing the over surface electrical clearance between adjacent electrical phases of different polarity.

13. The load terminal cover of claim 10, wherein said binding screw access covers are non-removable.

14. The load terminal cover of claim 13, wherein said non-removable binding screw access covers are integrally attached to said top flange by two pivot arms such that said binding screw access covers are rotated upwardly or downwardly to provide access to the load terminal binding screws.

15. The load terminal cover of claim 10, wherein said top and bottom flanges slidably and snugly engage the top and bottom surfaces, respectively, of the molded case circuit breaker.

16. The load terminal cover of claim 15, wherein said means for attaching said load terminal cover to the molded case circuit breaker includes at least one member extending inwardly from each of said top and bottom flanges such that a distal end of opposing said members positively engage recesses defined in the top and bottom surfaces of the molded case circuit breaker.

17. The load terminal cover of claim 16, wherein said member defined by one of said top or bottom flanges is hook-like in configuration such that a protrusion defined by one of the top or bottom surfaces of the molded case circuit breaker is positively engaged.

18. A terminal cover for a molded case circuit breaker having a load end enclosing at least one electrical terminal and a line end enclosing at least one electrical terminal, each of the circuit breaker's load and line ends having an end wall defining at least one aperture for accessing the respective electrical terminals, and a top surface defining at least one aperture for accessing a terminal binding screw associated with each of the electrical terminals and a bottom surface being generally parallel to the top surface, said terminal cover comprising:

a terminal cover end wall, being generally flat, dimensioned to cover said circuit breaker end wall and defining at least one conductor knockout for receiving an electrical conductor, a top flange and a bottom flange being generally perpendicular to and spaced apart by said end wall, said top and bottom flanges each defining at least one means for positively engaging the top and bottom surfaces, respectively, of the molded case circuit breaker for attaching said terminal cover to said molded case circuit breaker.

19. The terminal cover of claim 18, wherein said at least one conductor knockout can be a series of tangential or concentric knockouts, each increasing in diameter to accommodate one or more electrical conductors of larger diameter.

* * * * *